United States Patent [19]

Lecher

[11] Patent Number: 4,697,855

[45] Date of Patent: Oct. 6, 1987

[54] BOTTLE TROUGH SECURITY DEVICE

[75] Inventor: Theodore R. Lecher, Brookfield, Wis.

[73] Assignee: The Perlick Company, Inc., Milwaukee, Wis.

[21] Appl. No.: 871,780

[22] Filed: Jun. 9, 1986

[51] Int. Cl.[4] ..... A47B 81/00

[52] U.S. Cl. ..... 312/290; 312/138 R; 312/323

[58] Field of Search ..... 220/331, 333; 312/138 R, 297, 322, 323, 290

[56] References Cited

U.S. PATENT DOCUMENTS

| | | | |
|---|---|---|---|
| 919,619 | 4/1909 | McComb | 312/297 X |
| 2,004,896 | 6/1935 | Knott | 312/297 X |
| 2,602,015 | 7/1952 | Newman | 312/138 |

*Primary Examiner*—Joseph Falk

*Attorney, Agent, or Firm*—James E. Nilles; James R. Custin

[57] ABSTRACT

A closure for a bartender's bottle trough comprises three hingedly connected flat panels. In an open position the three panels, in coplanar relationship, are disposed edgewise upright, serving as a rear wall of the bottle trough and vertically slidably confined in channels along the rear edges of the bottle trough end walls. The three panels can be raised and swung forward to a closed position in which the medial panel is horizontal and overlies the tops of panels in the trough and the other two extend down from it to close the front and rear of the trough.

2 Claims, 5 Drawing Figures

BOTTLE TROUGH SECURITY DEVICE

FIELD OF THE INVENTION

This invention relates to bartender's bottle troughs (also known as speed rails) in which bottles containing liquor and the like are supported in a row directly behind a tavern bar to be readily accessible for service; and the invention is more specifically concerned with a security device for a bottle trough that can be quickly and easily shifted between a closed position in which bottles in the bottle trough are concealed and inaccessible, for security during non-operating hours, and an open out-of-the-way position behind the bottles in the bottle trough, occupied during business hours.

BACKGROUND OF THE INVENTION

For fast and efficient service in a tavern bar, the bartender must have easy access to such equipment as glass washers, rinse tanks, drain boards, ice bins, etc., and to bottles of liquor and other beverages that are to be dispensed across the bar. All of these items should be accessible to the bartender as he faces towards the customer's side of the bar. To that end, the fixed equipment is installed under the bar and a bottle trough for supporting a row of bottles is installed just in front of the fixed equipment, that is, at the bartender's side of it.

Because alcoholic beverages have a high value in relation to volume, the owner of a tavern must be as much concerned to prevent pilfering of liquor and the like as to arrange the stock for the bartender's convenience. The bottle trough is located and arranged to achieve both of these objectives. It is at such an elevation above the floor—a little above knee level—that the bartender can reach down and remove a bottle from it without stooping or bending and can easily reach across bottles in it to the fixed equipment behind it; but at the same time bottles in the bottle trough are practically inaccessible from the customer's side of the bar, so that pilfering from the bottle trough is not likely to occur when the bartender is present.

Heretofore, however, there has been no satisfactory protection for bottles in a bottle trough at times when the bar is not in operation.

In many establishments all bottles have been removed from the bottle trough at the end of the business day and transferred to a cabinet that could be locked. Of course the bottles had to be transferred back to the bottle trough when operations were to be resumed. Obviously such transfer and retransfer was time consuming, and it also presented the possibility that a bottle might be dropped and broken.

As another security measure the bottle trough was sometimes so arranged that a pair of rods could be fastened to it that extended along the row of bottles in the trough, close to their necks, to captivate them in the trough. Although the rods could be installed and removed easily enough, they left the tops of the bottles exposed, so that it was not difficult to siphon out their contents.

A frequently used security device was a hood-like or box-like cover that was carried to the bottle trough, set in place over it and locked to it. Because this cover concealed the bottles and blocked access to them it was satisfactory from the security standpoint, but it was large and bulky so that carrying it to and from the bottle trough and installing and removing it were difficult and awkward. A very important disadvantage was that it had to be stored somewhere away from the bottle trough during business hours, and, because of its bulk, a completely suitable and convenient storage place for it was seldom available.

Because covers and closures are such common devices, one might assume that it would be easy enough to provide a door-like or hood-like hinged and lockable closure for a bottle trough, but as demonstrated by the unsatisfactory character of the security devices heretofore employed, there has been no obvious completely satisfactory solution to the problem. A bottle trough closure cannot be arranged to swing to an open position in which it is in front of the bottle trough, to either end of it or above it. In front of the bottle trough it will be in the bartender's way as he reaches for a bottle or otherwise moves about in the performance of his work; at either end of the bottle trough it is likely to be in the bartender's way as he moves along the bar; and above the bottle trough it would block access to the drain board, ice chest and other equipment under the bar. Whatever its nature, the security device must be made entirely of material that is impervious to water and to alcoholic and carbonated beverages, and with respect to both its form and the material of which it is made it must be capable of being quickly, easily and thoroughly cleaned.

SUMMARY OF THE INVENTION

It is an object of this invention to provide a security closure for a bartender's bottle trough that can be quickly and easily moved between an out-of-the-way open position and a closed position wherein all bottles in the bottle trough are concealed and inaccessible.

A more specific object of the invention is to provide a simple and inexpensive bottle trough closure of the character described that can be easily manipulated between its open and closed positions, can be quickly locked in its closed position by means of a padlock, and is suitable for being made of a sturdy and attractive material such as stainless steel that can be kept clean easily and is not adversely affected by water, beverages and cleaning materials.

Another specific object of the invention is to provide a bottle trough closure of the character described that can be quickly and easily swung from an open position to a closed position in which it presents an attractive appearance and conceals all bottles in the bottle trough while rendering them inaccessible.

A further specific object of the invention is to provide a bottle trough closure of the character described that has an open position in which it is disposed wholly behind the bottle trough and at a level where it does not interfere with the bartender's access to bottles in the bottle trough and to equipment behind it.

It is also a specific object of this invention to provide a bottle trough closure of the character described that can be completely separated from the bottle trough in a few seconds, so that it can be carried away from the bottle trough for cleaning, but which normally remains connected to the bottle trough but movable relative to it between open and closed positions.

In general, these and other objects of the invention that will appear as the description proceeds are achieved in the bartender's bottle trough of this invention, which is intended for holding a row of bottles containing liquor or the like at an elevation above floor level such that they are normally readily accessible from above and in front of the bottle trough and which is of the type comprising a pair of opposite upright end walls, each having a front edge and a substantially vertical rear edge, an elongated bottom wall extending lengthwise between said end walls and upon which bottles are supported, and an elongated edgewise upright front wall extending lengthwise between said end walls and having an upper edge at a distance above said bottom wall which is substantially smaller than the height of a bottle. The bottle trough of this invention is characterized by channel means on each end wall defining a groove which extends along the rear edge of the end wall and opens towards the other end wall, and supporting means on the top of each end wall defining an upwardly facing surface which projects no more than a small distance towards the other end wall. The invention is further characterized by cover means movable to and from a closed position cooperating with said end walls to prevent access to bottles in the bottle trough, said cover means comprising elongated front, medial and rear panels, each having a length to extend between said end walls and having a pair of opposite longitudinal edges. The cover means has a first hinge connection between the medial panel and the front panel, extending along a front longitudinal edge of the medial panel and an upper longitudinal edge of the front panel and has a second hinge connection between the medial panel and the real panel, extending along a rear longitudinal edge of the medial panel and an upper longitudinal edge of the rear panel. Said panels are of such widths between said longitudinal edges of each that with the cover means in its closed position the medial panel overlies said supporting means and is supported by them with its surfaces substantially horizontal to extend across the tops of bottles on the bottom wall, the front panel extends down from the medial panel to near said upper edge of the front wall, and the rear panel, with its opposite end portions received in said grooves, extends down from the medial panel partway to the level of the bottom wall. The hinge connections enable the front and medial panels to be swung up into coplanar relationship with the rear panel and the entire cover means to be slid downward in said grooves to an out-of-the-way position in which the front panel is behind bottles on the bottom wall. Cooperating securement means on the front panel and on one of said walls provides for locking the cover means in its closed position.

BRIEF DESCRIPTION OF THE DRAWINGS

In the accompanying drawings, which illustrate what is now regarded as a preferred embodiment of the invention.

DETAILED DESCRIPTION OF THE PREFERRED EMBODIMENT OF THE INVENTION

Figure 1:
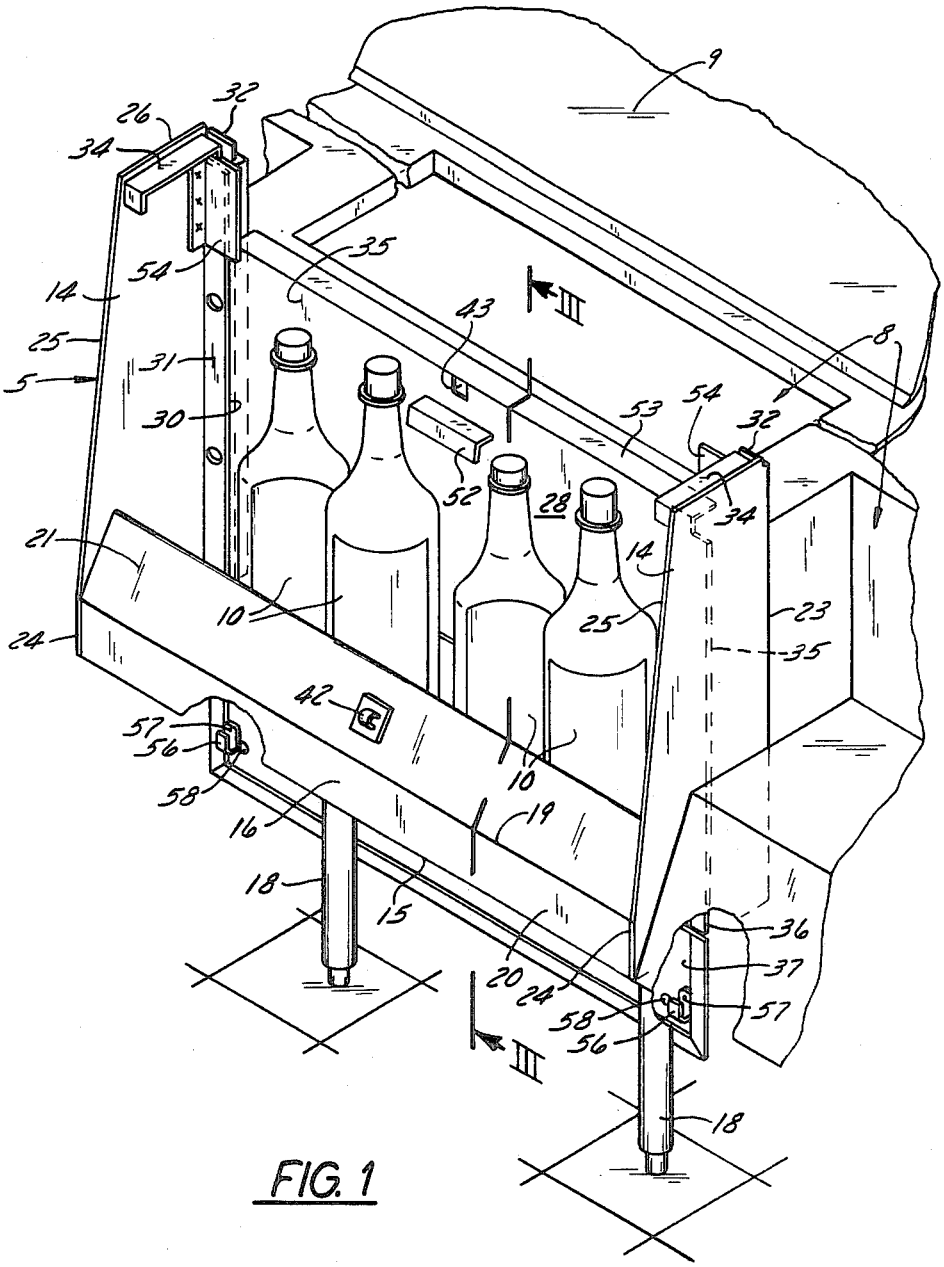
FIG. 1 is a perspective view of the bottle trough of this invention in its open condition.

A bottle trough 5 (also known as a speed rail) that embodies the principles of this invention is usually located at the bartender's side of a bar, directly in front of equipment designated generally by 8 which is under the bar top 9 and which may comprise a glass drain, glass storage rack, ice compartment and the like. The bottle trough 5 is arranged to hold bottles 10 of liquor or the like in a single row that extends lengthwise along the bar. It supports the bottles at such height above the floor that the bartender can readily reach down and pick up a desired bottle without stooping or bending but can nevertheless reach across the bottle trough and the bottles in it for easy access to the equipment 8.

The bottle trough 5 of this invention is generally conventional in comprising a pair of opposite upright end walls 14 that are relatively narrow from front to rear, an elongated bottom wall 15 which extends lengthwise between the end walls, and an elongated front wall 16 which likewise extends lengthwise between the end walls and which has a bottom edge at or near the level of the bottom wall and has a top edge at a level low enough for the labels on bottles behind it to be substantially visible above it. To dispose the bottles 10 at a convenient height the bottle trough is so supported in front of the equipment 8 on legs 18 that its bottom wall 15 is at a suitable elevation above the floor.

In this case the front wall 16 has a bend or crease 19 along its length, about midway between its top and bottom edges, that defines in it a vertical lower portion 20 and a rearwardly and upwardly inclined upper portion 21. The end walls 14 are pentagonal, each having a vertical rear edge 23 along its full height, a short lower front edge 24 which is vertical and is about equal in height to the lower portion 20 of the front wall, a substantially longer upper front edge 25 that extends up from the lower front edge at a small rearward inclination, and a horizontal top edge 26, the length of which is about equal to the diameter of a conventional one-liter liquor bottle. The top edges 26 of the end walls are at a distance above the bottom wall that is somewhat greater than the height of a bottle.

The bottle trough 5 of this invention has no fixed rear wall. Instead, it has a cover 28, described below, which serves as a rear wall when it is in an open position and which then cooperates with the front wall 16 to confine bottles in a row that extends lengthwise along the bottle trough.

For cooperation with the cover 28 each end wall 14 has a groove 30 that extends lengthwise along its rear edge 23 and opens towards the other end wall. This groove can be defined by a channel member 31 of S-shaped cross-section which is secured to a flange 32 on the end wall that extends along its rear edge and projects laterally towards the other end wall. Each end wall also has a horizontal flange 34 extending along its top edge that projects laterally a small distance towards the other end wall.

The cover 28 comprises three hingedly connected rectangular panels of a metal such as stainless steel, namely a front panel 35, a medial panel 36 and a rear panel 37. Each of these panels has a length substantially equal to the distance between the end walls. When the cover is in its open position, shown in FIG. 1, the three panels 35, 36, 37 are in coplanar upright relationship, all having their end portions received in the grooves 30 in the end walls, and they form a rear wall for the bottle trough as mentioned above.

Figure 2:
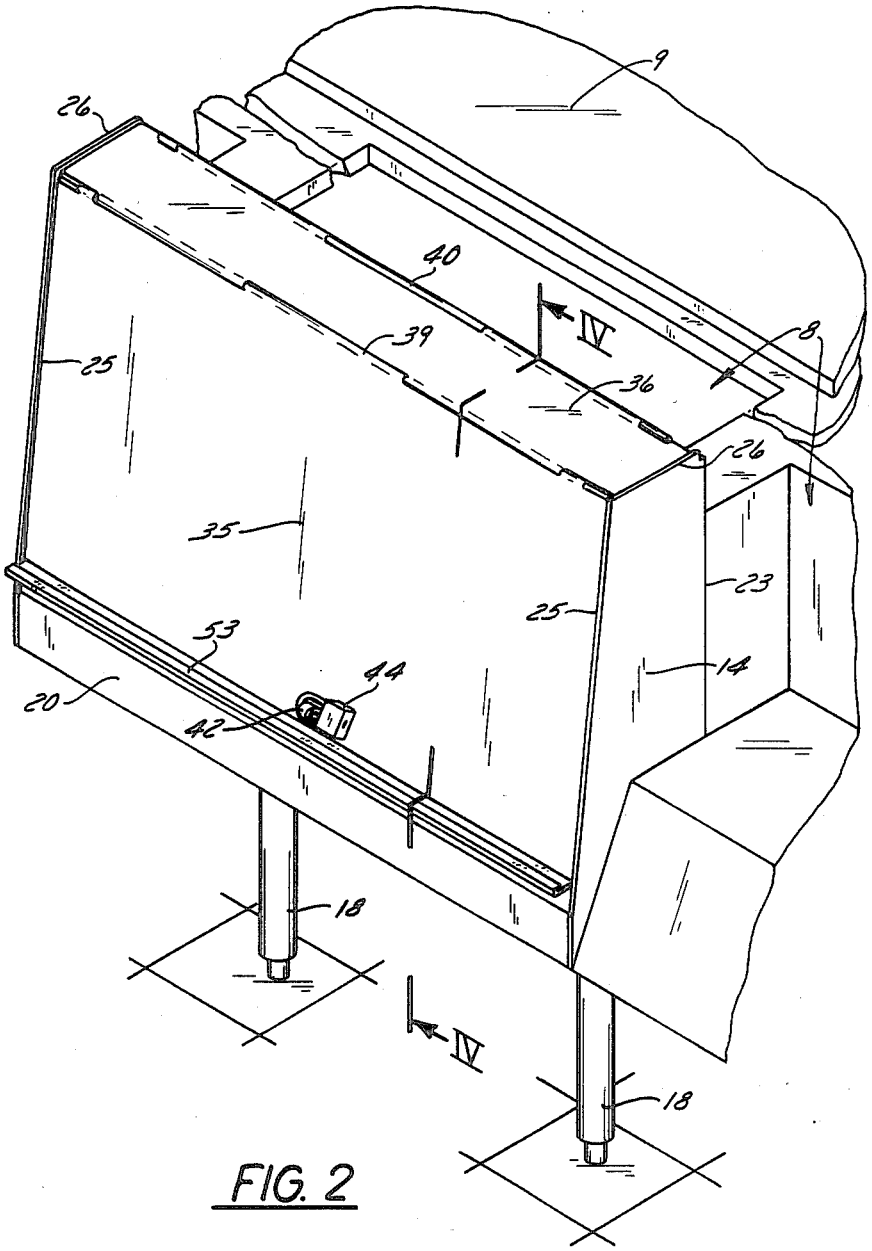
FIG. 2 is a view generally similar to FIG. 1 but showing the bottle trough in its closed condition.
Figure 3:
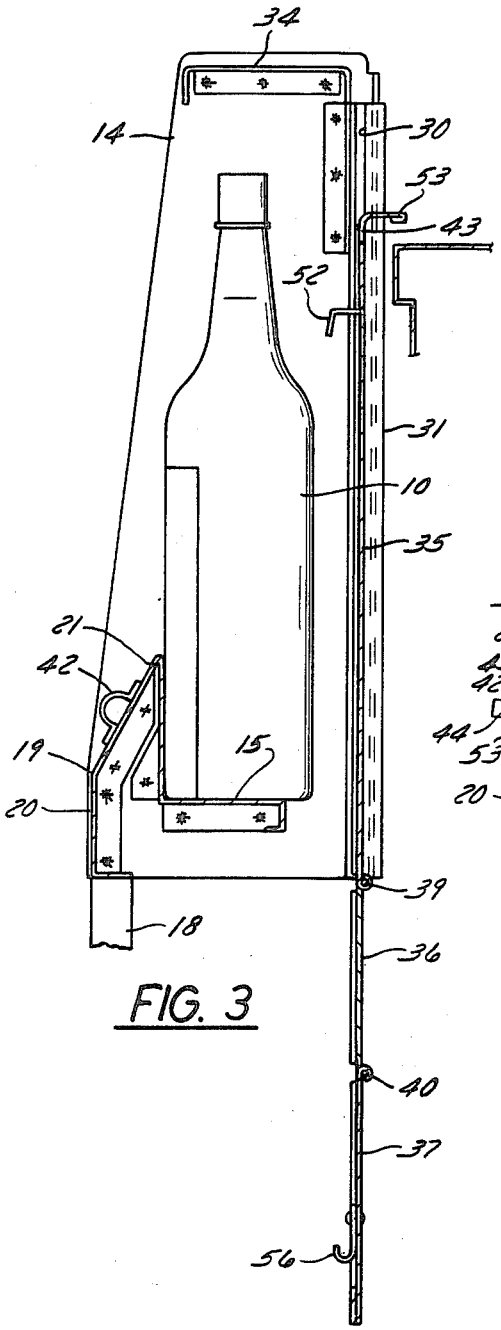
FIG. 3 is a view in section taken on the plane of the line III—III in FIG. 1.
Figure 4:
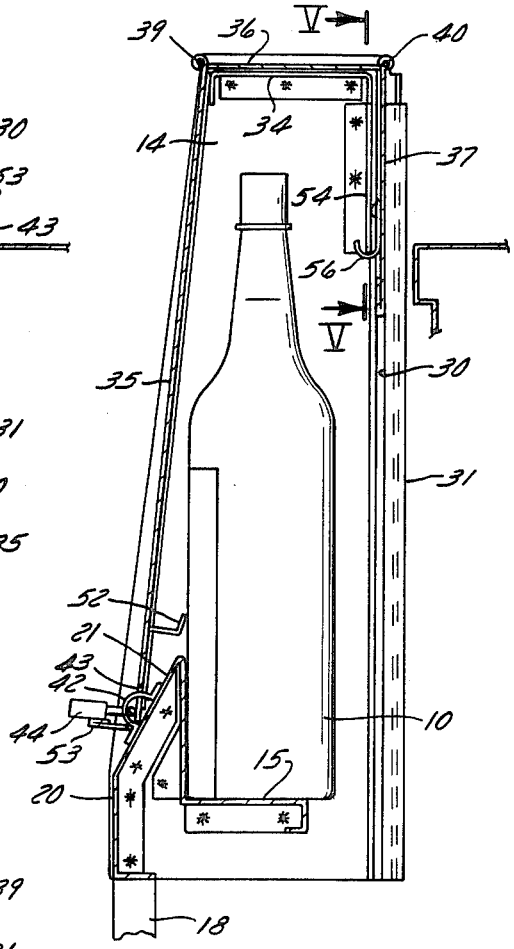
FIG. 4 is a view in section on the plane of the line IV—IV in FIG. 2.
Figure 5:
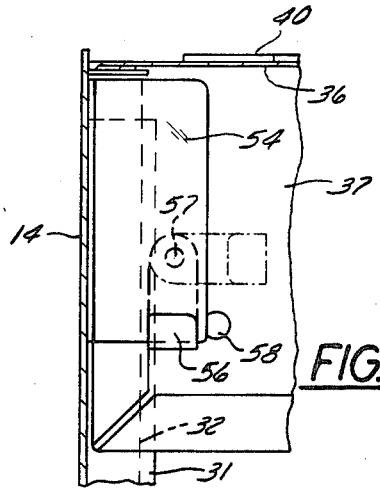
FIG. 5 is a fragmentary sectional view, on the plane of the line V—V in FIG. 4 and on an enlarged scale.

With the cover 28 in its closed position, in which it is shown in FIG. 2, the medial panel 36 overlies the flanges 34 on the tops of the end walls, to be supported by those flanges in a horizontal attitude extending across the tops of the bottles in the bottle trough. The medial panel 36 thus has a width, as measured between its longitudinal edges, that is approximately equal to the length of the horizontally extending top edges 26 of the end walls. Extending along the front one of the two longitudinal edges of the medial panel 36 and an upper longitudinal edge of the front panel 35 is a hinge 39 by which those two panels are connected for flatwise swinging relative to one another. The front panel 35 is of such width between its longitudinal edges that in the closed position of the cover its lower longitudinal edge is spaced a little below the top edge of the front wall 16. Along the rear longitudinal edge of the medial panel 36 and an upper longitudinal edge of the rear panel 37 extends a second hinge 40 by which those two panels are connected for flatwise relative swinging.

The rear panel 37 always remains in the grooves 30 in the end walls, except at such times as the cover is to be carried away from the bottle trough for cleaning or the like. The width of the rear panel 37 as measured between its longitudinal edges is such that with the cover in closed position it extends down from the medial panel 36 partway to the level of the bottom wall and far enough to block access to the tops of bottles in the bottle trough. Thus the bottom edge of the rear panel 37, with the cover closed, is at or near the level of the top of equipment 8 behind the bottle trough, which cooperates with the cover in blocking access to the bottles.

The front panel 35 is wide enough for its lower portion to overlie the inclined upper portion 21 of the front wall when the cover is closed. To provide for locking the cover closed, a sturdy U-shaped staple 42 is secured to the upper portion 21 of the front wall, in the middle of it and projecting forwardly from it with its bight portion forward, to project through a slot 43 in the lower portion of the front panel 35 of the cover. Thus the shackle of a padlock 44 engaged in the staple 42 locks the front panel 35 of the cover against swinging upward, while the grooves 30 in the end walls similarly confine the rear panel 37, and the cover is thus locked in its closed position in which it completely conceals the bottles in the bottle trough and prevents access to them.

When the padlock 44 is removed, the hinges 39 and 40 allow the front and medial panels 35, 36 to be swung up to vertical positions in which they are coplanar with the rear panel 37, and the entire cover can then be slid down in the grooves 30 to its open position in which the bottom edge of the front panel 35, which is then uppermost, is a little above the level of the top of equipment 8 behind the bottle trough. It will be apparent that the cover can be brought from one to the other of its positions in a few seconds.

A handle 52 is preferably secured to the front panel 35 of the cover, near its lower edge and projecting outwardly from its outer surface, to facilitate movement of the cover between its open and closed positions.

At the lower edge of the front panel 35, extending along the full length of that edge, is a laterally outwardly projecting flange 53. In the open position of the cover the end portions of this flange engage the upper ends of the channel members 31 to support the cover with the nominally lower edge of the front panel 35 a little above the level of the top of fixed equipment 8 behind the bottle trough.

As the cover is being raised from its open position, cooperating disengageable abutment means on the rear panel 37 of the cover and on the end walls 14 normally prevent the cover from being lifted so high that the rear panel 37 will be disengaged from the grooves 30. As here shown, the abutment means on each end wall comprises a small vertical plate 54 which is fixed to the end wall just in front of the track member 31 on it and which projects edgewise from the end wall towards the opposite end wall. The abutment means on the cover comprises a hook 56 near each end of the rear panel 37, projecting inward from the inner surface of that panel to engage under the bottom edge of its adjacent plate 54. Each of the hooks 56 is connected to the rear panel 37 by means of a single rivet 57 through the upper portion of the hook, so that the hook can be swung laterally about the rivet to a releasing position in which its inwardly projecting lower end is clear of the plate 54 and the entire cover can be lifted out of the grooves 30 for cleaning or the like. Adjacent to each hook is an inwardly projecting dimple 58 in the rear panel that tends to confine the hook in the position in which it is engageable with its adjacent abutment plate 54.

From the foregoing description taken with the accompanying drawings it will be apparent that this invention provides a securement device for a bartender's bottle trough which is in the nature of a closure that can be quickly moved between a closed position in which the closure completely conceals bottles in the bottle trough and blocks access to them and an open position in which the closure is behind the bottle trough and completely out of the way.

What is claimed as the invention is:

1. A bartender's bottle trough for holding a row of bottles containing liquor or the like at an elevation above floor level such that they are normally readily accessible from above and in front of the bottle trough, said bottle trough comprising a pair of opposite upright end walls, each having a front edge and a substantially vertical rear edge, an elongated bottom wall extending lengthwise between said end walls and upon which bottles can be supported, and an elongated upright front wall extending lengthwise between said end walls and having an upper edge at a distance above said bottom wall which is substantially smaller than the height of a bottle, said bottle trough being characterized by:

A. channel means on each end wall defining a groove extending along the rear edge of the end wall and opening towards the other end wall;

B. supporting means on the top of each end wall defining an upwardly facing surface which projects no more than a small distance towards the other end wall;

C. cover means movable to and from a closed position cooperating with said walls to prevent access to bottles in said bottle trough.

(1) said cover means comprising (a) elongated front, medial and rear panels, each having a length to extend between said end walls and having a pair of opposite longitudinal edges, (b) a first hinge connection between said medial panel and said front panel, extending along a front longitudinal edge of said medial panel and an upper longitudinal edge of said front panel, and (c) a second connection between said medial panel and said rear panel, extending along a rear longitudinal edge of said medial panel and an upper longitudinal edge of said rear panel, (2) said panels being of such width between said longitudinal edges of each that with the cover means in its closed position, (a) the medial panel overlies and is supported with its surface horizontal by said supporting means, to extend across bottles on the bottom wall, (b) the front panel extends down from the medial panel to near said upper edge of the front wall, and (c) the rear panel, with opposite end portions received in said grooves, extends down from said medial panel partway to the level of said bottom wall, said hinge connections enabling the front and medial panels to be swung up into coplanar relationship with the rear panel and the entire cover means to be slid down in said grooves to an out-of-the-way position in which the front panel is behind bottle on the bottom wall;

D. cooperating securement means on said front panel and on one of said walls providing for locking the cover means in its closed position;

E. a pair of abutment means, one on each end wall, each defining a downwardly facing abutment that is forwardly adjacent to the groove in its end wall; and F. a pair of abutment elements on said rear panel, one for each of said abutment means, each located near an end of said rear panel, each said abutment element having a portion defining an upwardly facing abutment which is engageable with its abutment means when said rear panel is at a predetermined upper position wherein said medial panel overlies said supporting means, to thus prevent upward disengagement of the rear panel from said grooves, and each said abutment element being mounted on the rear panel for movement of its said portion relative to that panel between an operative position in which its said portion is engageable with said abutment means and an inoperative position in which its said portion is clear of said abutment means so that the rear panel can be drawn upwardly out of said grooves.

2. The bartender's bottle trough of claim 1 wherein said front panel is of such width that, with the cover means in closed position, it extends below said upper edge of the front wall and forwardly overlies the front wall, further characterized in that said securement means comprises a staple on said front wall, near said upper edge thereof, projecting forwardly from the front wall to be receivable in an aperture in the front panel and to receive the shackle of a padlock that confines the cover means in its closed position.

* * * * *